US007250838B2

(12) United States Patent
Shen et al.

(10) Patent No.: US 7,250,838 B2
(45) Date of Patent: Jul. 31, 2007

(54) PACKAGING OF A MICRO-MAGNETIC SWITCH WITH A PATTERNED PERMANENT MAGNET

(75) Inventors: Jun Shen, Phoenix, AZ (US); Prasad S. Godavarti, Gilbert, AZ (US)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 11/097,390
(22) Filed: Apr. 4, 2005

(65) Prior Publication Data

US 2006/0055491 A1 Mar. 16, 2006

Related U.S. Application Data

(63) Continuation of application No. 10/338,042, filed on Jan. 8, 2003, now abandoned.

(60) Provisional application No. 60/345,636, filed on Jan. 8, 2002.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | |
|---|---|---|---|
| 4,065,677 | A | 12/1977 | Micheron et al. |
| 4,461,968 | A | 7/1984 | Kolm et al. |
| 4,496,211 | A | 1/1985 | Daniel |
| 4,570,139 | A | 2/1986 | Kroll |
| 5,016,978 | A | 5/1991 | Fargette et al. |
| 5,048,912 | A | 9/1991 | Kunikane et al. |
| 5,398,011 | A | 3/1995 | Kimura et al. |

(Continued)

FOREIGN PATENT DOCUMENTS

DE 19820821 C1 12/1999

(Continued)

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

E. Fullin, J. Gobert, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

(Continued)

*Primary Examiner*—Elvin Enad
*Assistant Examiner*—Bernard Rojas
(74) *Attorney, Agent, or Firm*—Sterne, Kessler, Goldstein & Fox

(57) ABSTRACT

A method and apparatus for packaging a plurality of micro-magnetic switches is described. A bonded substrate structure includes a first substrate, a second substrate, and a magnetic layer. The first substrate has a plurality of cantilevers formed thereon. The second substrate has a first surface that is bonded to the first substrate. Each cantilever of the plurality of cantilevers on the first substrate is housed in a corresponding space formed between the first substrate and the second substrate. The magnetic layer is formed on a second surface of the first and/or second substrate to induce a magnetization in a magnetic material of each housed cantilever. The bonded substrate structure is singulated to form a plurality of separate micro-magnetic switch packages. Each micro-magnetic switch package of the plurality of micro-magnetic switch packages includes at least one housed cantilever.

20 Claims, 15 Drawing Sheets

U.S. PATENT DOCUMENTS

| | | | | |
|---|---|---|---|---|
| 5,472,539 | A | 12/1995 | Saia et al. | |
| 5,475,353 | A | 12/1995 | Roshen et al. | |
| 5,557,132 | A | 9/1996 | Takahashi | |
| 5,629,918 | A | 5/1997 | Ho et al. | |
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,025,767 | A * | 2/2000 | Kellam et al. | 335/128 |
| 6,028,689 | A | 2/2000 | Michalicek et al. | |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A * | 9/2000 | Bishop et al. | 310/40 MM |
| 6,143,997 | A | 11/2000 | Feng et al. | |
| 6,160,230 | A | 12/2000 | McMillen et al. | |
| 6,297,072 | B1 | 10/2001 | Tilmans et al. | |
| 6,384,353 | B1 * | 5/2002 | Huang et al. | 200/181 |
| 6,410,360 | B1 | 6/2002 | Steenberge | |
| 6,458,618 | B1 * | 10/2002 | Allen et al. | 438/53 |
| 6,469,602 | B2 | 10/2002 | Ruan et al. | |
| 6,495,895 | B1 | 12/2002 | Peterson et al. | |
| 6,624,003 | B1 * | 9/2003 | Rice | 438/106 |
| 6,633,212 | B1 * | 10/2003 | Ruan et al. | 335/78 |
| 6,635,509 | B1 | 10/2003 | Ouellet | |
| 6,809,412 | B1 * | 10/2004 | Tourino et al. | 257/678 |
| 2003/0042567 | A1 | 3/2003 | Tilmans et al. | |
| 2003/0179057 | A1 | 9/2003 | Shen et al. | |
| 2004/0027218 | A1 | 2/2004 | Stafford et al. | |
| 2005/0168306 | A1 * | 8/2005 | Cohn et al. | 335/78 |
| 2006/0071324 | A1 * | 4/2006 | Lu et al. | 257/704 |
| 2006/0091983 | A1 * | 5/2006 | Robert | 335/78 |
| 2006/0115323 | A1 * | 6/2006 | Coppeta et al. | 403/270 |

FOREIGN PATENT DOCUMENTS

| | | | |
|---|---|---|---|
| DE | 10031569 | A1 | 2/2001 |
| EP | 0452012 | A2 | 10/1991 |
| EP | 0452012 | A3 | 10/1991 |
| EP | 0685864 | A1 | 12/1995 |
| EP | 0709911 | A2 | 5/1996 |
| EP | 0709911 | A3 | 5/1996 |
| EP | 0780858 | A1 | 6/1997 |
| EP | 0887879 | A1 | 6/1998 |
| EP | 0869519 | A1 | 10/1998 |
| FR | 2572546 | A1 | 5/1986 |
| JP | 54-161952 | A | 12/1979 |
| JP | 4-275519 | A | 10/1992 |
| JP | 6-251684 | A | 9/1994 |
| WO | WO 97/39468 | A1 | 10/1997 |
| WO | WO 98/34269 | A1 | 8/1998 |
| WO | WO 99/27548 | A1 | 6/1999 |

OTHER PUBLICATIONS

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

P10D Electricity & Magnetism Lecture 14, Internet Source: http://scitec.uwhichill.edu.bb/cmp/online/P10D/Lecture14/lect14.htn, Jan. 3, 2000, pp. 1-5.

Ultraminiature Magnetic Latching to 5-relays SPDT DC TO C Band, Series RF 341, product information from Teledyne Relays, 1998.

M. Ruan et al., "Latching Microelectromagnetic Relays" , Sensors and Actuators A 91 (Jul. 15, 2001), Copyright 2001 Elsevier Science B.V., pp. 346-350.

Xi-Qing Sun, K.R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Communication", Proceedings Solid State Sensor and Actuator Workshop, Hilton Head, 1998, Jun. 1998, pp. 304-307.

John A. Wright, Yu-Chong Tai, and Shih-Chia Chang, "A Large-Force, Fully-Integrated MEMS Magnetic Actuator", Tranducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

English-Language Abstract of JP 6251684, published Sep. 9, 1994, 1 page.

English-Language Abstract of JP 5416952, published Dec. 22, 1979, 1 page.

English-Language Abstract of WO 9927548, published Jun. 3, 1999, 1 page.

* cited by examiner

PACKAGING OF A MICRO-MAGNETIC SWITCH WITH A PATTERNED PERMANENT MAGNET

CROSS-REFERENCE TO RELATED APPLICATIONS

This application claims priority to U.S. Provisional Application No. 60/345,636 filed Jan. 8, 2002, which is incorporated herein by reference.

BACKGROUND OF THE INVENTION

1. Field of the Invention

The present invention relates to electronic and optical switches. More specifically, the present invention relates to the packaging of a micro-magnetic switch with a patterned permanent magnet.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Non-latching micro-magnetic relays are known. The relay includes a permanent magnet and an electromagnet for generating a magnetic field that intermittently opposes the field generated by the permanent magnet. The relay must consume power in the electromagnet to maintain at least one of the output states. Moreover, the power required to generate the opposing field would be significant, thus making the relay less desirable for use in space, portable electronics, and other applications that demand low power consumption.

A bi-stable, latching switch that does not require power to hold the states is therefore desired. Such a switch should also be reliable, simple in design, low-cost and easy to manufacture, and should be useful in optical and/or electrical environments.

Furthermore, micro-magnetic relays can be sensitive to environmental factors, including being hermetically sensitive, and being sensitive to dust and other particulate contaminants. Still further, a convenient means for interfacing micro-magnetic relays with various application circuits is desired.

Thus, a package effective at protecting and providing electrical access to a micro-magnetic switch is desired. Furthermore, the package must be cost-effective, and must be able to be produced in large quantities.

BRIEF SUMMARY OF THE INVENTION

A method and apparatus for packaging a plurality of micro-magnetic switches is described. A bonded substrate structure includes a first substrate, a second substrate, and a magnetic layer. The first substrate has a plurality of cantilevers formed on a first surface. The second substrate has a first surface that is bonded to the first surface of the first substrate. Each cantilever of the plurality of cantilevers on the first substrate is housed in a corresponding space formed between the first substrate and the second substrate. The magnetic layer is formed on a second surface of the second substrate to induce a magnetization in a magnetic material of each housed cantilever.

In a further aspect, the bonded substrate structure is separated to form a plurality of separate micro-magnetic switch packages. Each micro-magnetic switch package of the plurality of micro-magnetic switch packages includes one or more housed cantilevers. The micro-magnetic switches can be latching or non-latching.

In another aspect, the magnetic layer is alternatively formed on a second surface of the first substrate to induce a magnetization in a magnetic material of each housed cantilever. In other aspects, the magnetic layer may be formed on both of the first and second substrates.

In further aspects of the present invention, the magnetic layer is patterned to form a plurality of permanent magnets. Each permanent magnet induces the magnetization in the magnetic material of a corresponding housed cantilever.

The magnetic layer can be patterned on the first and/or second substrate by a variety of processes. For example, in one aspect, the magnetic layer can be screen printed on the first and/or second substrate. In another example aspect, a lithographic process can be used to deposit the magnetic on the first and/or second substrate. In another example aspect, the magnetic layer can be sputtered on the first and/or second substrate. In another example aspect, the magnetic layer can be electroplated on the first and/or second substrate. In another example aspect, the magnetic layer can be laminated on the first and/or second substrate.

In an aspect of the present invention, the space in which each cantilever is housed is formed by a corresponding cavity in the first surface of the first substrate. In an alternative aspect, the space is formed by a corresponding cavity in the first surface of the second substrate. In another alternative aspect, the space is formed by a combination of corresponding first and second cavities respectively in the first surfaces of the first and second substrates.

The latching or non-latching micro-magnetic switch packages of the present invention can be used in a plethora of products including household and industrial appliances, consumer electronics, military hardware, medical devices and vehicles of all types, just to name a few broad categories of goods. The latching micro-magnetic switch packages of the present invention have the advantages of compactness, simplicity of fabrication, and have good performance at high frequencies.

These and other objects, advantages and features will become readily apparent in view of the following detailed description of the invention.

BRIEF DESCRIPTION OF THE FIGURES

The above and other features and advantages of the present invention are hereinafter described in the following detailed description of illustrative embodiments to be read in conjunction with the accompanying drawing figures, wherein like reference numerals are used to identify the same or similar parts in the similar views.

Figure 1A:
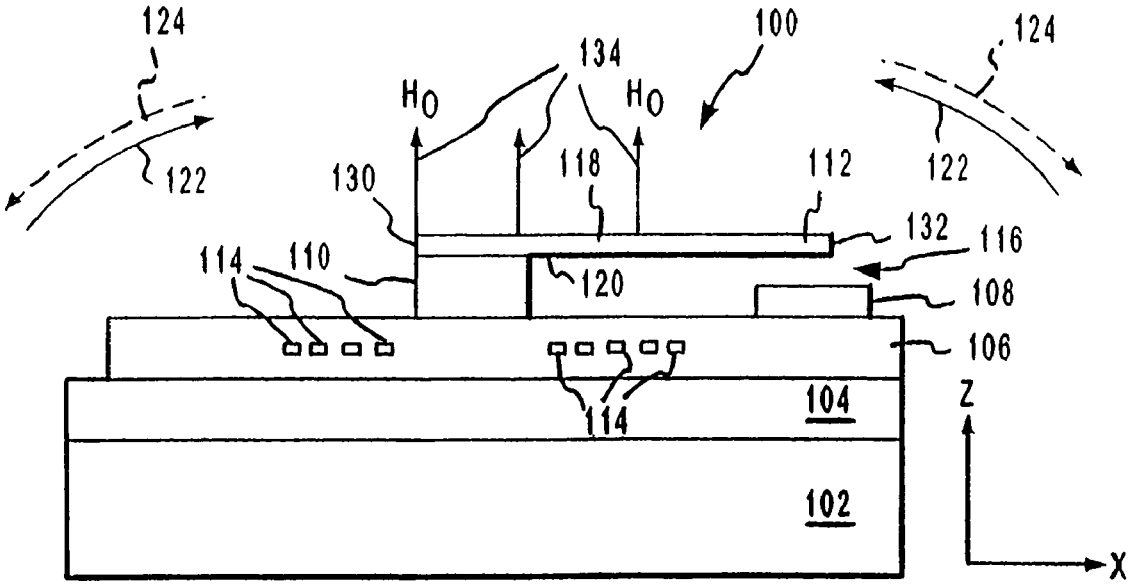
FIGS. 1A and 1B show side and top views, respectively, of an exemplary fixed-end latching micro-magnetic switch, according to an embodiment of the present invention.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, transmission line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal silicides are examples of other conductors.

The terms contact and via, both refer to structures for electrical connection of conductors from different interconnect levels. These terms are sometimes used in the art to describe both an opening in an insulator in which the structure will be completed, and the completed structure itself. For purposes of this disclosure, contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micro-magnetic latching switch is further described in U.S. Pat. No. 6,469,602 (titled Electronically Switching Latching Micro-magnetic Relay And Method of Operating Same). This patent provides a thorough background on micro-magnetic latching switches and is incorporated herein by reference in its entirety.

An overview of a latching switch of the present invention is described in the following sections. This is followed by a detailed description of embodiments for packaging multiple micro-magnetic latching switches.

Overview of a Latching Switch

Figure 1B:
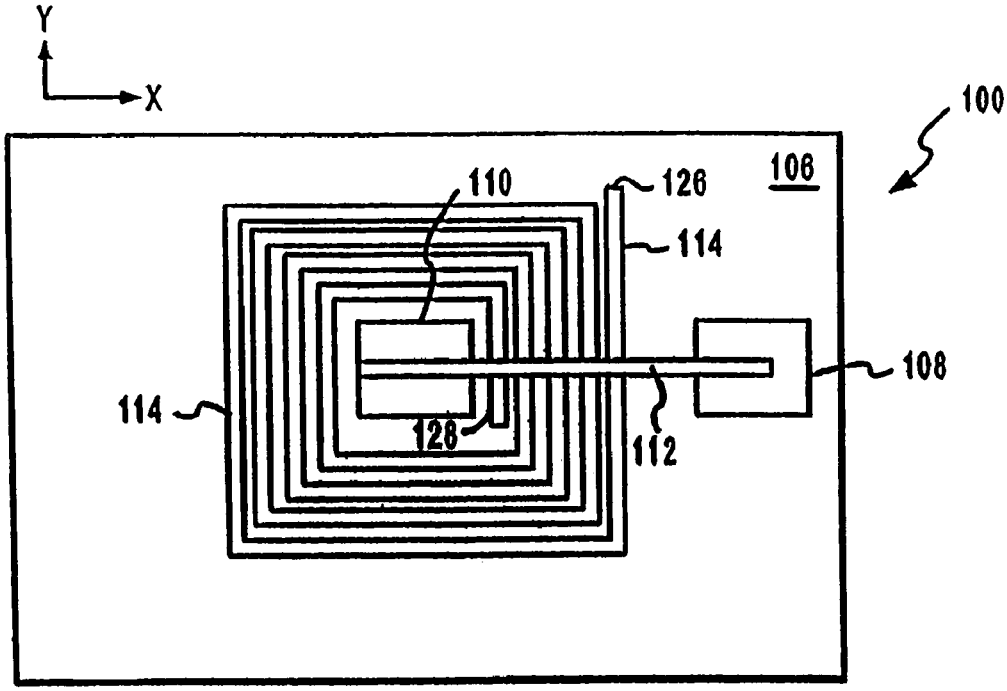

FIGS. 1A and 1B show side and top views, respectively, of a latching switch. The terms switch and device are used herein interchangeably to described the structure of the present invention. With reference to FIGS. 1A and 1B, an exemplary latching relay 100 suitably includes a magnet 102, a substrate 104, an insulating layer 106 housing a conductor 114, a contact 108 and a cantilever (moveable element) 112 positioned or supported above substrate by a staging layer 110.

Magnet 102 is any type of magnet such as a permanent magnet, an electromagnet, or any other type of magnet capable of generating a magnetic field $H_0$ 134, as described more fully below. By way of example and not limitation, the magnet 102 can be a model 59-P09213T001 magnet available from the Dexter Magnetic Technologies corporation of Fremont, Calif., although of course other types of magnets could be used. Magnetic field 134 can be generated in any manner and with any magnitude, such as from about 1 Oersted to $10^4$ Oersted or more. The strength of the field depends on the force required to hold the cantilever in a given state, and thus is implementation dependent. In the exemplary embodiment shown in FIG. 1A, magnetic field $H_0$ 134 can be generated approximately parallel to the Z axis and with a magnitude on the order of about 370 Oersted, although other embodiments will use varying orientations and magnitudes for magnetic field 134. In various embodiments, a single magnet 102 can be used in conjunction with a number of relays 100 sharing a common substrate 104.

Substrate 104 is formed of any type of substrate material such as silicon, gallium arsenide, glass, plastic, metal or any other substrate material. In various embodiments, substrate 104 can be coated with an insulating material (such as an oxide) and planarized or otherwise made flat. In various embodiments, a number of latching relays 100 can share a single substrate 104. Alternatively, other devices (such as transistors, diodes, or other electronic devices) could be formed upon substrate 104 along with one or more relays 100 using, for example, conventional integrated circuit manufacturing techniques. Alternatively, magnet 102 could be used as a substrate and the additional components discussed below could be formed directly on magnet 102. In such embodiments, a separate substrate 104 may not be required.

Insulating layer 106 is formed of any material such as oxide or another insulator such as a thin-film insulator. In an exemplary embodiment, insulating layer is formed of Probimide 7510 material. Insulating layer 106 suitably houses conductor 114. Conductor 114 is shown in FIGS. 1A and 1B to be a single conductor having two ends 126 and 128 arranged in a coil pattern. Alternate embodiments of conductor 114 use single or multiple conducting segments arranged in any suitable pattern such as a meander pattern, a serpentine pattern, a random pattern, or any other pattern. Conductor 114 is formed of any material capable of conducting electricity such as gold, silver, copper, aluminum, metal or the like. As conductor 114 conducts electricity, a magnetic field is generated around conductor 114 as discussed more fully below.

Cantilever (moveable element) 112 is any armature, extension, outcropping or member that is capable of being affected by magnetic force. In the embodiment shown in FIG. 1A, cantilever 112 suitably includes a magnetic layer 118 and a conducting layer 120. Magnetic layer 118 can be formulated of permalloy (such as NiFe alloy) or any other magnetically sensitive material. Conducting layer 120 can be formulated of gold, silver, copper, aluminum, metal or any other conducting material. In various embodiments, cantilever 112 exhibits two states corresponding to whether relay 100 is "open" or "closed", as described more fully below. In many embodiments, relay 100 is said to be "closed" when a conducting layer 120, connects staging layer 110 to contact 108. Conversely, the relay may be said to be "open" when cantilever 112 is not in electrical contact with contact 108. Because cantilever 112 can physically move in and out of contact with contact 108, various embodiments of cantilever 112 will be made flexible so that cantilever 112 can bend as appropriate. Flexibility can be created by varying the thickness of the cantilever (or its various component layers), by patterning or otherwise making holes or cuts in the cantilever, or by using increasingly flexible materials.

Although the dimensions of cantilever 112 can vary dramatically from implementation to implementation, an exemplary cantilever 112 suitable for use in a micro-magnetic relay 100 can be on the order of 10-1000 microns in length, 1-40 microns in thickness, and 2-600 microns in width. For example, an exemplary cantilever in accordance with the embodiment shown in FIGS. 1A and 1B can have dimensions of about 600 microns×10 microns×50 microns, or 1000 microns×600 microns×25 microns, or any other suitable dimensions.

Contact 108 and staging layer 110 are placed on insulating layer 106, as appropriate. In various embodiments, staging layer 110 supports cantilever 112 above insulating layer 106, creating a gap 116 that can be vacuum or can become filled with air or another gas or liquid such as oil. Although the size of gap 116 varies widely with different implementations, an exemplary gap 116 can be on the order of 1-100 microns, such as about 20 microns, Contact 108 can receive cantilever 112 when relay 100 is in a closed state, as described below. Contact 108 and staging layer 10 can be formed of any conducting material such as gold, gold alloy, silver, copper, aluminum, metal or the like. In various embodiments, contact 108 and staging layer 110 are formed of similar conducting materials, and the relay is considered to be "closed" when cantilever 112 completes a circuit between staging layer 110 and contact 108. In certain embodiments wherein cantilever 112 does not conduct electricity, staging layer 110 can be formulated of non-conducting material such as Probimide material, oxide, or any other material. Additionally, alternate embodiments may not require staging layer 110 if cantilever 112 is otherwise supported above insulating layer 106.

Figure 1C:
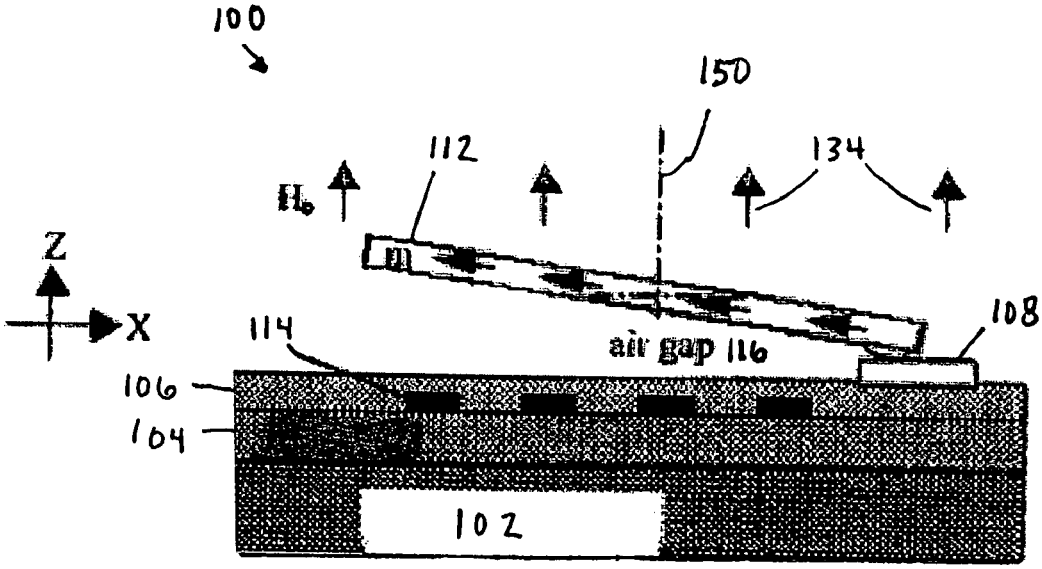
FIGS. 1C and 1D show side and top views, respectively, of an exemplary hinged latching micro-magnetic switch, according to an embodiment of the present invention.
Figure 1D:
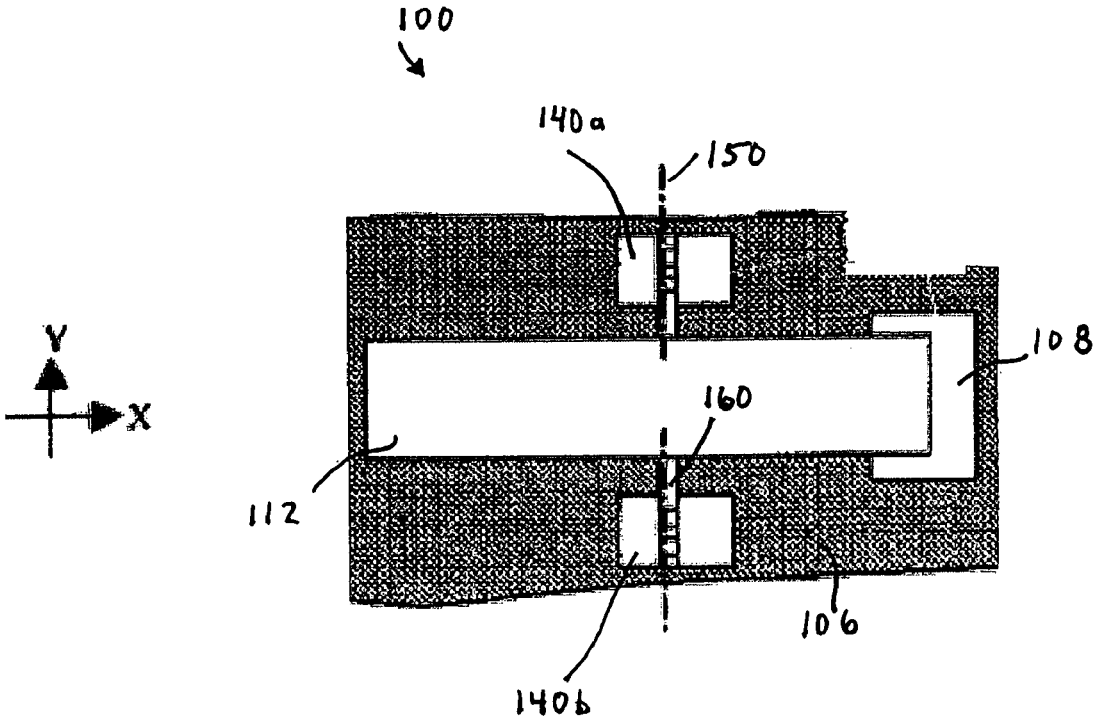

Alternatively, cantilever 112 can be made into a "hinged" arrangement. For example, FIGS. 1C and 1D show side and top views, respectively, of a latching relay 100 incorporating a hinge 160, according to an embodiment of the present invention. Hinge 160 centrally attaches cantilever 112, in contrast to staging layer 110, which attaches an end of cantilever 112. Hinge 160 is supported on first and second hinge supports 140*a* and 140*b*. Latching relay 100 shown in FIGS. 1C and 1D operates substantially similarly to the switch embodiment shown in FIGS. 1A and 1D, except that cantilever 112 flexes or rotates around hinge 160 when changing states. Indicator line 150 shown in FIG. 1C indicates a central axis of cantilever 112 around which cantilever 112 rotates. Hinge 160 and hinge supports 140*a* and 140*b* can be made from electrically or non-electrically conductive materials, similarly to staging layer 110. Relay 100 is considered to be "closed" when cantilever 112 completes a circuit between one or both of first and second hinge supports 140*a* and 104*b*, and contact 108.

Figure 1E:
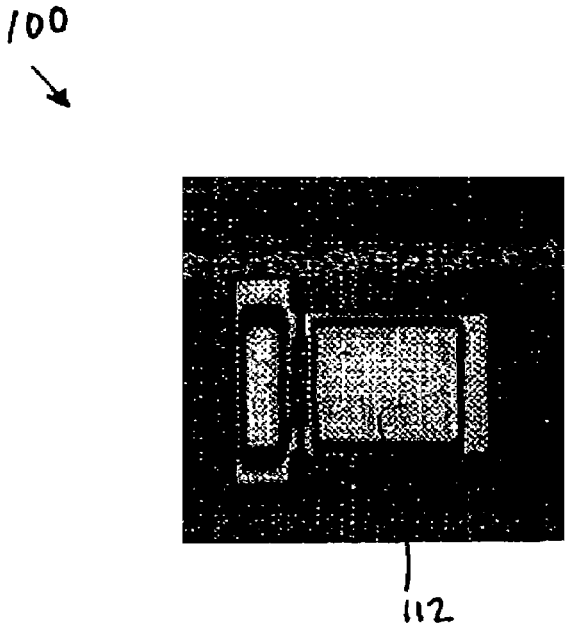
FIG. 1E shows an example implementation of the switch of FIGS. 1A and 1B, according to an embodiment of the present invention.
Figure 1F:
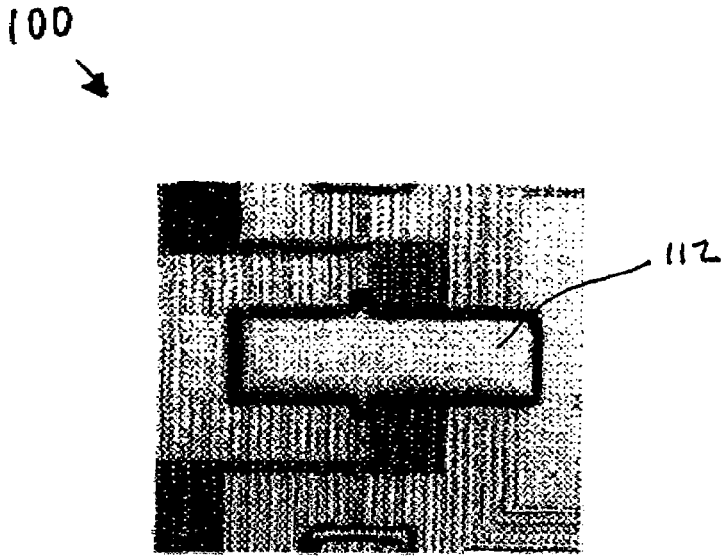
FIG. 1F shows an example implementation of the switch of FIGS. 1C and 1D, according to an embodiment of the present invention.

Relay 100 can be formed in any number of sizes, proportions, and configurations. FIGS. 1E and 1F show examples of relay 100, according to embodiments of the present invention. Note that the examples of relay 100 shown in FIGS. 1E and 1F are provided for purposes of illustration, and are not intended to limit the invention.

FIG. 1E shows an example relay 100 having a fixed end configuration, similar to the embodiment shown in FIGS. 1A and 1B. In the example of FIG. 1E, cantilever 112 has the dimensions of 700 μm×300 μm×30 μm. A thickness of cantilever 112 is 5 μm. Air gap 116 (not shown in FIG. 1E) has a spacing of 12 μm under cantilever 112. An associated coil 114 (not shown in FIG. 1E) has 20 turns.

FIG. 1F shows an example relay 100 having a hinge structure, similarly to the embodiment shown in FIGS. 1C and 1D. In the example of FIG. 1F, cantilever 112 has the dimensions of 800 μm×200 μm×25 μm. A pair of torsion flexures (not shown in FIG. 1F) are located in the center of cantilever 112 to provide the hinge function. Each flexure has dimensions of 280 μm×20 μm×3 μm. Air gap 116 (not shown in FIG. 1F) has a spacing of 12 μm under cantilever 112. An associated coil 114 (not shown in FIG. 1F) has 20 turns.

Principle of Operation of a Micro-Magnetic Latching Switch

When it is in the "down" position, the cantilever makes electrical contact with the bottom conductor, and the switch is "ON" (also called the "closed" state). When the contact end is "up", the switch is "OFF" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-Stability

Figure 2:
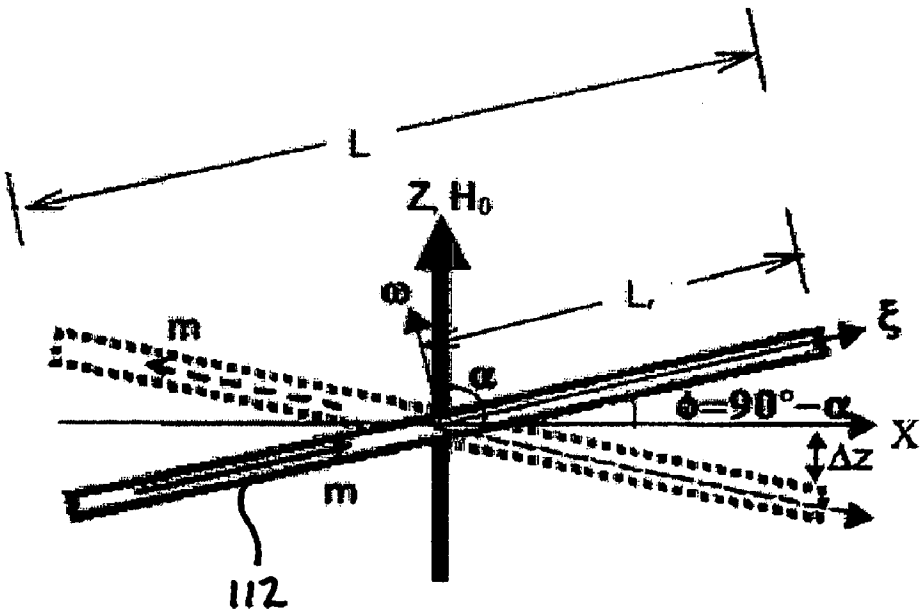
FIG. 2 illustrates the principle by which bi-stability is produced.

The principle by which bi-stability is produced is illustrated with reference to FIG. 2. When the length L of a permalloy cantilever 112 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle (α) between the cantilever axis (ξ) and the external field ($H_0$) is smaller than 90°, the torque is counterclockwise; and when α is larger than 90°, the torque is clockwise. The bi-directional torque arises because of the bi-directional magnetization (i.e., a magnetization vector "m" points one direction or the other direction, as shown in FIG. 2) of the cantilever (m points from left to right when α<90°, and from right to left when α>90°). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bi-directional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the ξ-component (along the cantilever, see FIG. 2) of this field that is used to reorient the magnetization (magnetization vector "m") in the cantilever. The direction of the coil current determines whether a positive or a negative ξ-field component is generated. Plural coils can be used. After switching, the permanent magnetic field holds the cantilever in this state until the next switching event is encountered. Since the ξ-component of the coil-generated field (Hcoil-ξ) only needs to be momentarily larger than the ξ-component [$H_0\xi$-$H_0\cos(\alpha)=H_0\sin(\phi)$, $\alpha=90°-\phi$] of the permanent magnetic field and φ is typically very small (e.g., φ≦5°), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance die torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

$$B_2 \cdot n = B_1 \cdot n,\ B_2 \times n = (\mu_2/\mu_1)\ B_1 \times n$$

or $$H_2 \cdot n = (\mu_2/\mu_1)\ H_1 \cdot n,\ H_2 \times n = H_1 \times n$$

Figure 3:
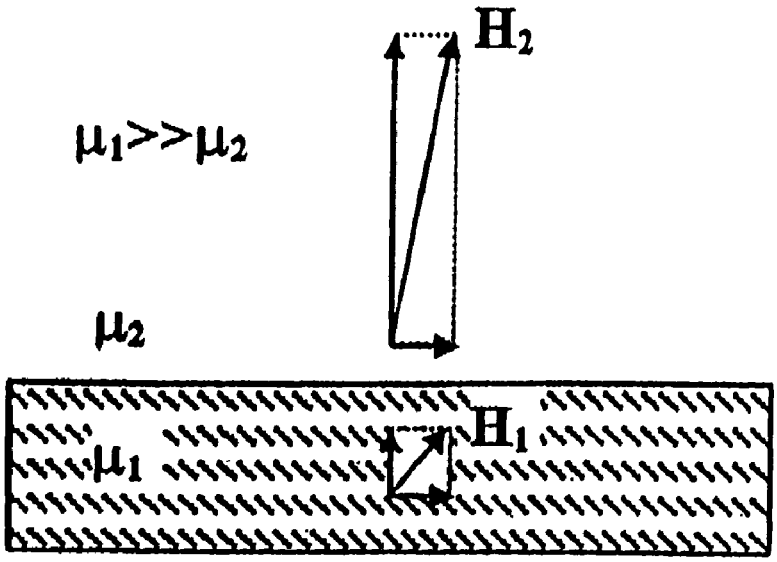
FIG. 3 illustrates the boundary conditions on the magnetic field (H) at a boundary between two materials with different permeability.

If μ1>>μ2, the normal component of H2 is much larger than the normal component of H1, as shown in FIG. 3. In the limit (μ1/μ2)□□, the magnetic field H2 is normal to the boundary surface, independent of the direction of H1 (barring the exceptional case of H1 exactly parallel to the interface). If the second media is air (μ2=1), then B2=μ0 H2, so that the flux lines B2 will also be perpendicular to the surface. This property is used to produce magnetic fields that are perpendicular to the horizontal plane of the cantilever in a micro-magnetic latching switch and to relax the permanent magnet alignment requirements.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

The term "micro-magnetic switch" will hereafter be used to refer to either the latching or non-latching variety.

Micro-Magnetic Switch Packaging Embodiments

Structural and operational implementations for the packaging of micro-magnetic switches according to the present invention are described in detail as follows. Additional packaging embodiments will become apparent to persons skilled in the relevant art(s) from the teachings herein. Package types that may be formed by the present invention include leaded and leadless packages, and surface mounted and non-surface mounted package types. For example, the present invention is applicable to packaging in dual-in-line packages (DIPs), leadless chip carrier (LCC) packages (including plastic and ceramic types), plastic quad flat pack (PQFP) packages, thin quad flat pack (TQFP) packages, small outline IC (SOIC) packages, pin grid array (PGA) packages (including plastic and ceramic types), and ball grid array (BGA) packages (including ceramic, tape, metal, and plastic types).

As described above, various conventional packaging techniques are applicable to the present invention, such as wire or ribbon bonding, flipchip or even wafer-scale packaging.

The micro-magnetic switches described in the sections above can be formed and packaged according to the embodiments described below. These embodiments are provided for illustrative purposes only, and are not limiting. Alternative embodiments will be apparent to persons skilled in the relevant art(s) based on the discussion contained herein. As will be appreciated by persons skilled in the relevant art(s), other packaging schemes for micro-magnetic switches are within the scope and spirit of the present invention.

Figure 4:
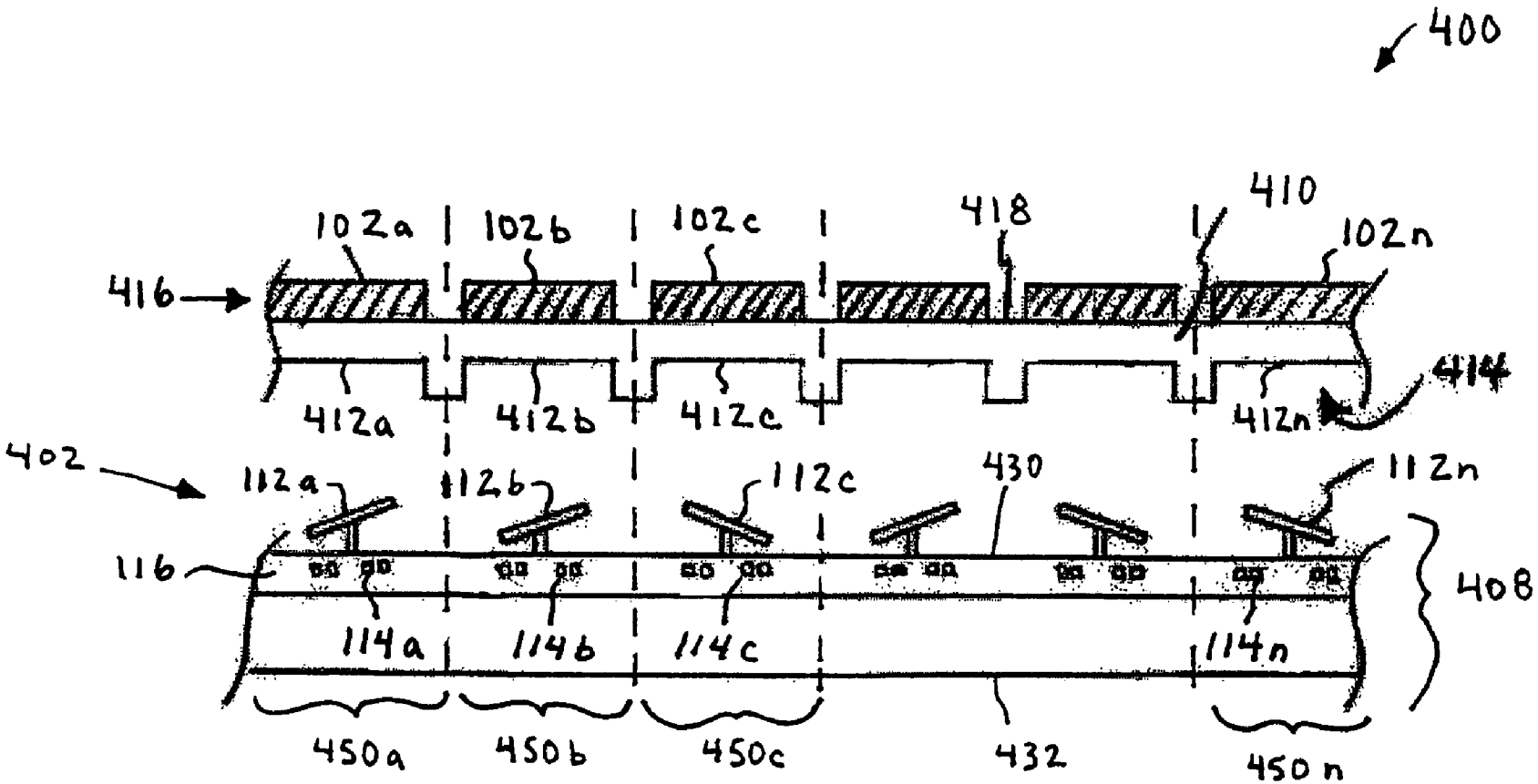
FIGS. 4 and 6-9 illustrate various example embodiments for packaging micro-magnetic latching switches using first and second substrates, according to the present invention.

FIG. 4 illustrates an example micro-magnetic switch packaging configuration 400, according to an embodiment of the present invention. Configuration 400 allows the formation of a plurality of micro-magnetic switch packages. As shown in FIG. 4, configuration 400 includes a first substrate 408, a second substrate 410, and a permanent magnetic layer 416. In embodiments, permanent magnetic layer 416 is formed on one or both of first substrate 408 and second substrate 410. First substrate 408 and second substrate 410 are bonded together to form a bonded substrate structure that can be separated to form multiple, fully-operational micro-magnetic switch packages. Configuration 400 is described in further detail as follows.

As shown in FIG. 4, first substrate 408 has a plurality of switches 402 formed on a first surface 430. Plurality of switches 402 can be arranged in a two dimensional array of rows and columns, or other arrangements as would be apparent to persons skilled in the relevant art. Each switch of plurality of switches 402 can comprise any of the various types of micro-magnetic relays having a permanent magnet, such as relay 100 described above.

Each switch 402 includes one of a plurality of cantilevers 112*a-n* and one of a plurality of coils 114*a-n*. Coils 114*a-n* are imbedded in insulating layer 106. As described above, insulating layer 106 is a dielectric or other insulating material. Each coil 114*a-n* is positioned adjacent to a corresponding one of cantilevers 112*a-n*. Each coil 114*a-n* is used to actuate the adjacent one of cantilevers 112*a-n*, as is described more fully above. Note that for ease of illustration, contact, permalloy layers and other specific features of plurality of switches 402 are not shown. Other coil arrangements are possible without departing from the spirit and scope of the present invention. The specific coil arrangement selected is not material to the present invention.

Figure 5A:
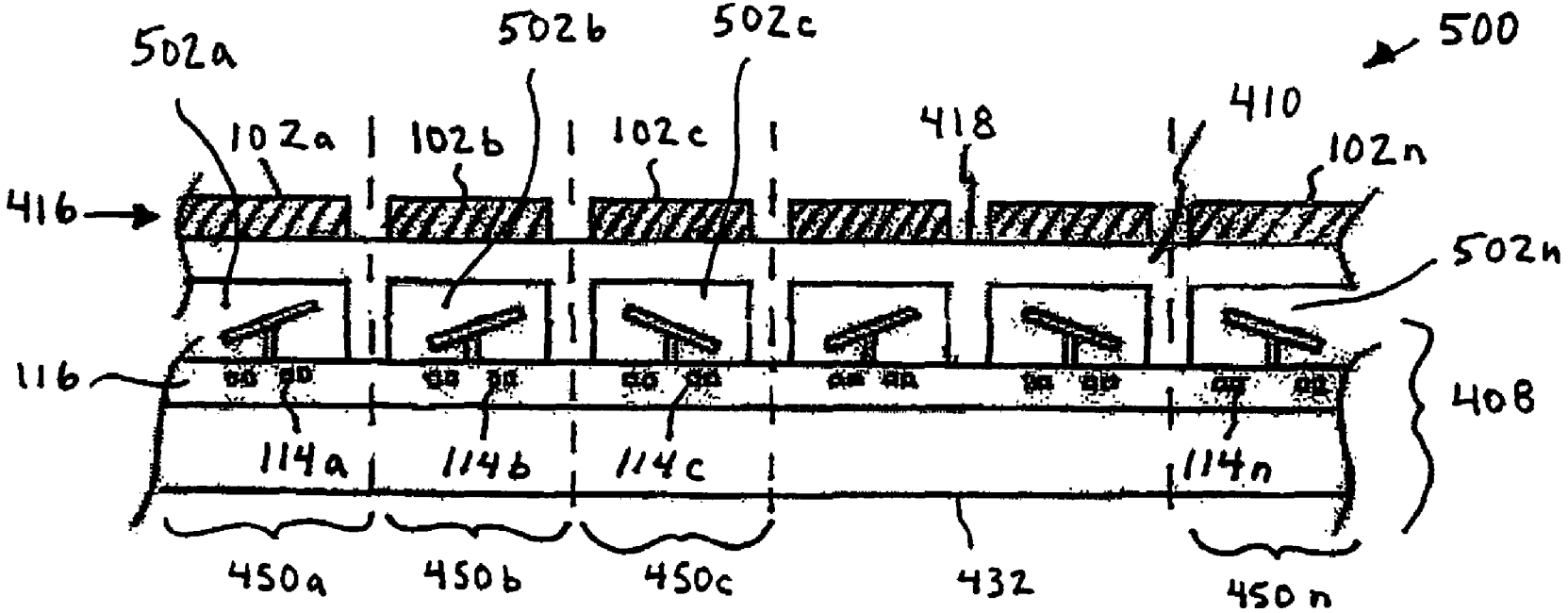
FIG. 5A illustrates a bonded substrate structure including a plurality of micro-magnetic latching switches, according to an embodiment of the present invention.

As shown in FIG. 4, second substrate 410 has a plurality of wells or cavities 412*a-n* etched in a first surface 414. When bonded to first substrate 408, cavities 412*a-n* form spaces that each house one or more of switches 402. FIG. 5A shows a bonded substrate structure 500 formed by bonding first substrate 408 and second substrate 410 together. As shown in FIG. 5A, a plurality of spaces 502*a-n* are formed between first and second substrates 408 and 410 in bonded substrate structure 500. In the example of FIG. 5A, each of spaces 502*a-n* houses a respective one of cantilevers 112*a-n*.

Before or after first substrate 408 and second substrate 410 are bonded together, permanent magnetic layer 416 is formed on a second surface 418 of second substrate 410. Permanent magnetic layer 416 is patterned on second surface 418 of second substrate 410 to form a plurality of permanent magnets 102*a-n*. Each permanent magnet of permanent magnets 102*a-n* is present to induce a magnetization in the magnetic material of a corresponding one of cantilevers 112*a-n*. For example, permanent magnet 102*a* is used to induce the magnetization in a magnetic layer (such as magnetic layer 118 shown in FIG. 1) of cantilever 112*a*.

Forming/patterning permanent magnetic layer 416 on a substrate surface has advantages over individually applying permanent magnets to the substrate surface. For example, less time may be consumed by patterning a single permanent magnetic layer 416 when compared to applying multiple permanent magnets in a serial fashion. The patterning process of the present invention separates the permanent magnetic layer 416 into individual magnets. This can allow for more precise positioning of the individual magnets than when magnets must be positioned one-by-one (such as by a pick-and-place device).

Furthermore, conventional patterning techniques can be used to pattern permanent magnetic layer 416. Such conventional patterning techniques include screen printing, lithography with deposition, sputtering or electroplating, lamination, or the like. The material(s) used for, and thickness of permanent magnetic layer 416 will become apparent to persons skilled in the relevant art(s) based on the description herein, and is implementation specific.

Figure 5B:
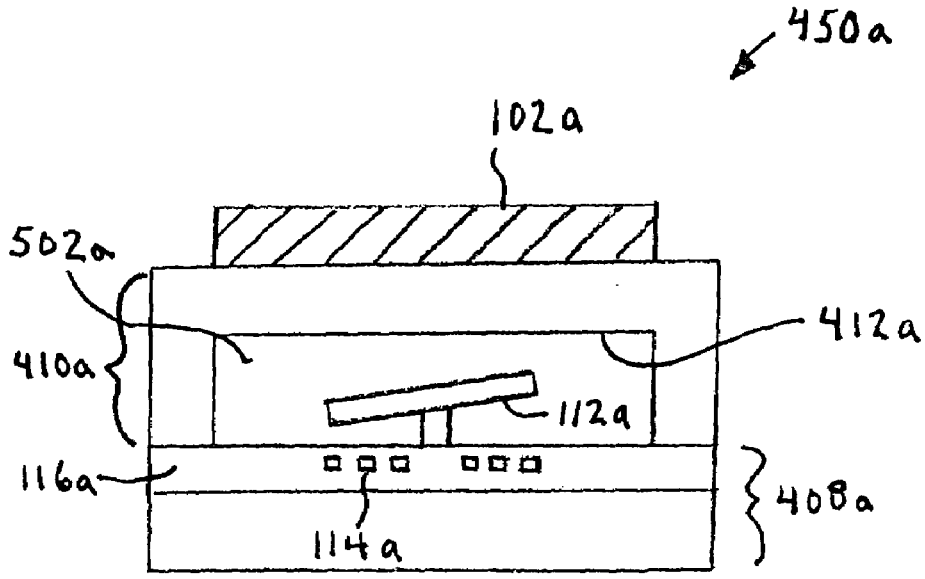
FIG. 5B illustrates a separate packaged micro-magnetic latching switch, according to an embodiment of the present invention.

After first and second substrates 408 and 410 are bonded together, the resulting bonded substrate structure 500 can be "singulated" or separated into individual chip components, or chips having any number of switches 402. For example, FIG. 5A shows partitions for singulating bonded substrate structure 500 into a plurality of micro-magnetic switch packages 450*a-n*. FIG. 5B shows an example micro-magnetic switch package 450*a* resulting from the singulation of bonded substrate structure 500, according to an embodiment of the present invention. Micro-magnetic switch package 450*a* can be attached to a circuit board or elsewhere to be used in any number of applications.

As shown in FIG. 5B, cantilever 112*a* is housed in package 450*a*. Package 450*a* provides hermetic and/or other types of environmental protection for cantilever 112*a*. As described above, package 450*a* has a space 502*a* formed therein by cavity 412*a*. When actuated, cantilever 112*a* can move freely in space 502*a* between its respective states. Thus, cavity 412*a* must provide sufficient clearance for cantilever 112*a* to move freely. Furthermore, proper alignment of first and second substrates 408 and 410 is required so that each cantilever 112 on first substrate 408 is properly housed in the corresponding space 502 formed between first and second substrates 408 and 410.

Figure 5C:
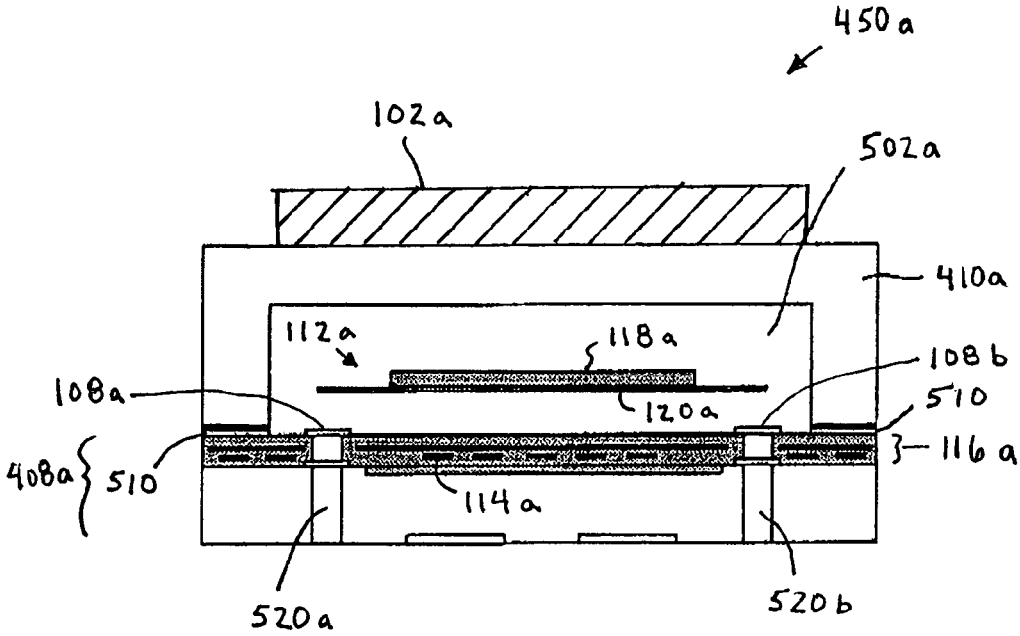
FIG. 5C illustrates the packaged switch of FIG. 5B with additional detail, according to an example embodiment of the present invention.

FIG. 5C shows package 450*a* of FIG. 5B, with additional detail, according to an example embodiment of the present invention. For example, an example seal ring 510 is shown in FIG. 5C for package 450*a*. Seal rings are further described below. Also as shown in FIG. 5C, package 450*a* includes first and second contacts 108*a* and 108*b*. Contact 108*a* can receive cantilever 112*a* when the switch of package 450*a* is in a first state, and contact 108*b* can receive cantilever 112*a* when the switch of package 450*a* is in a second state. In other configurations for cantilever 112*a*, only one contact 108 may be present, or other numbers or locations for contact(s) 108.

As shown in FIG. 5C, first and second vias 520*a* and 520*b* are respectively electrically coupled to first and second contacts 108*a* and 108*b*. Any number of vias 520, conductive traces, and other conductors can be present in first substrate 408*a* (and in some cases can be present in second substrate 408*b*) to couple any number of contacts 108 and/or other contact points and/or signals in package 450*a* to external contact points of package 450*a*. Such external contact points can include external contact pins or pads, including solder ball pads, that are present on an edge and/or surface of package 450*a* for interfacing electrical signals of package 450*a* with a circuit board or other surface.

FIGS. 6-9 show alternative configurations for packaging micro-magnetic switch packages, according to example embodiments of the present invention. Note that the embodiments shown in FIGS. 4 and 6-9, and described herein, can be combined in any manner, as would be apparent to persons skilled in the relevant art(s) from the teachings herein.

Figure 6:
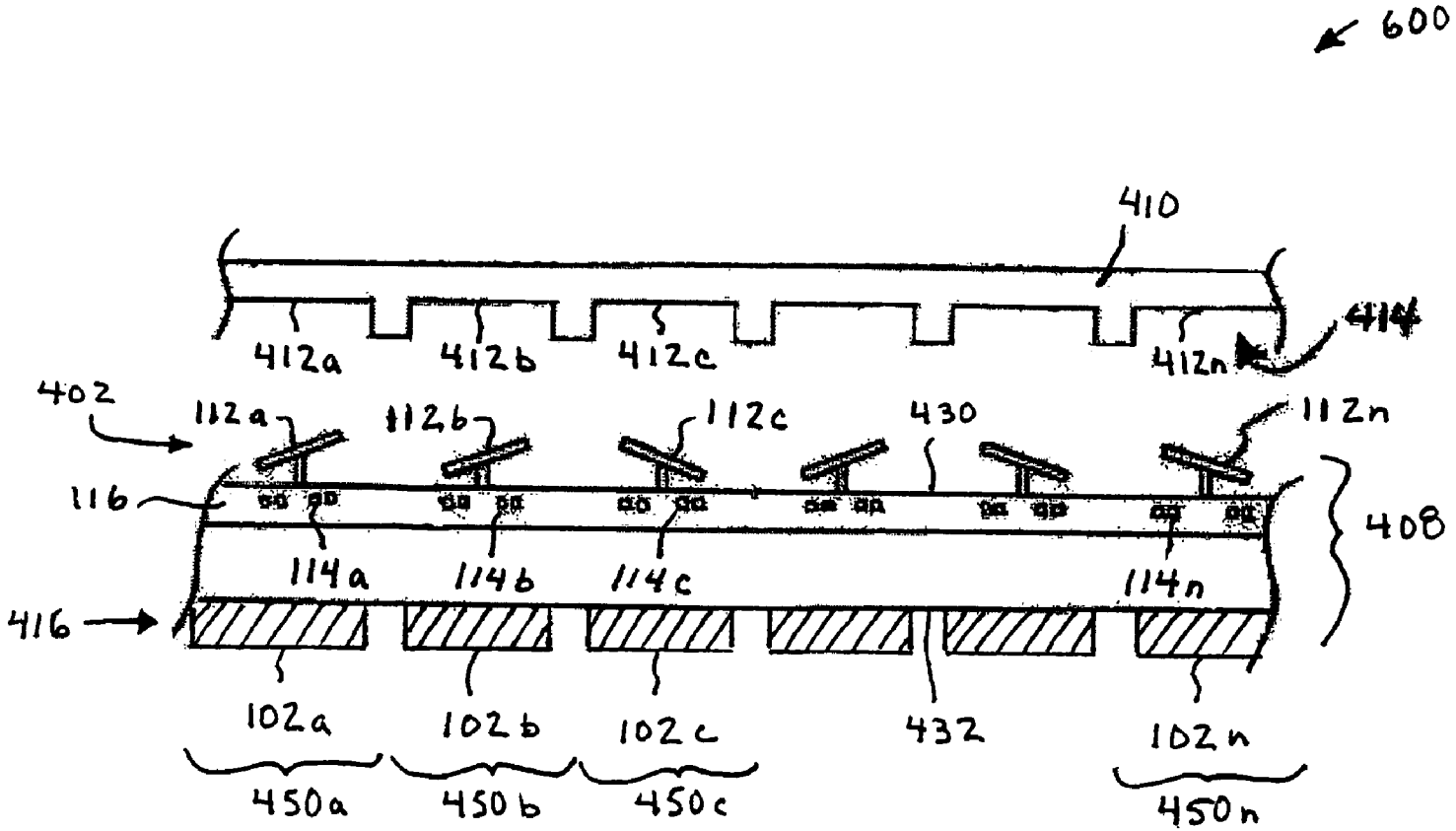

FIG. 6 shows a micro-magnetic switch packaging configuration 600, according to an example embodiment of the present invention. Configuration 600 is similar to configuration 400 shown in FIG. 4, except that permanent magnetic layer 416 is formed on a second surface 432 of first substrate 408.

Figure 7:
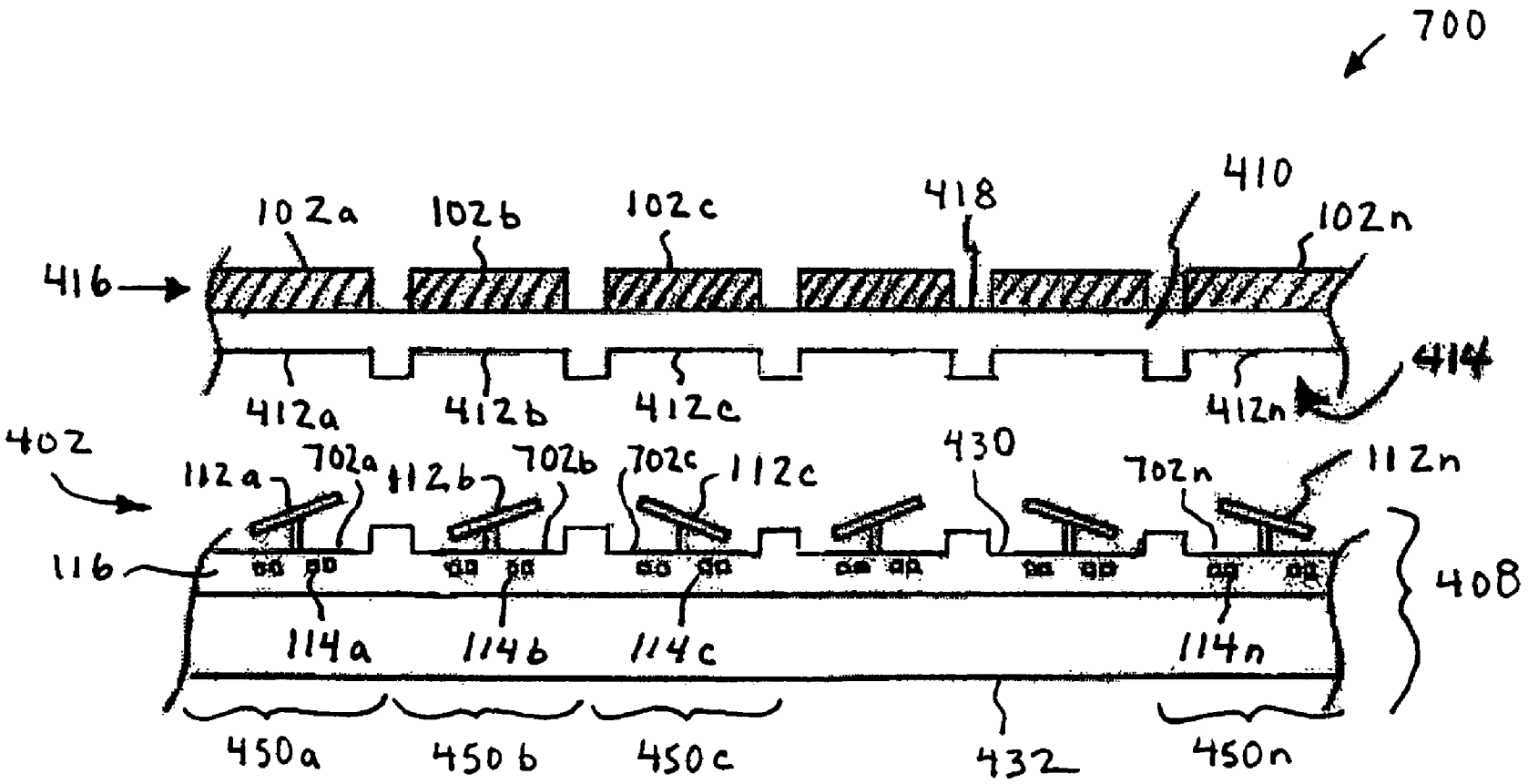

FIG. 7 shows a micro-magnetic switch packaging configuration 700, according to another example embodiment of the present invention. Configuration 700 is similar to configuration 400 shown in FIG. 4, except that a second plurality of cavities 702*a-n* are formed in first surface 430 of first substrate 408. Each of cantilevers 112*a-n* are located on first surface 430 in a respective one of cavities 702*a-n*. When first substrate 408 and second substrate 410 are bonded together, first plurality of cavities 412*a-c* and second plurality of cavities 702*a-n* are aligned, forming a space for each of cantilevers 112*a-n*. A cantilever 112 can move freely between states in the space formed by a corresponding one of first plurality of cavities 412*a-c* and a corresponding one of second plurality of cavities 702*a-n*.

Figure 8:
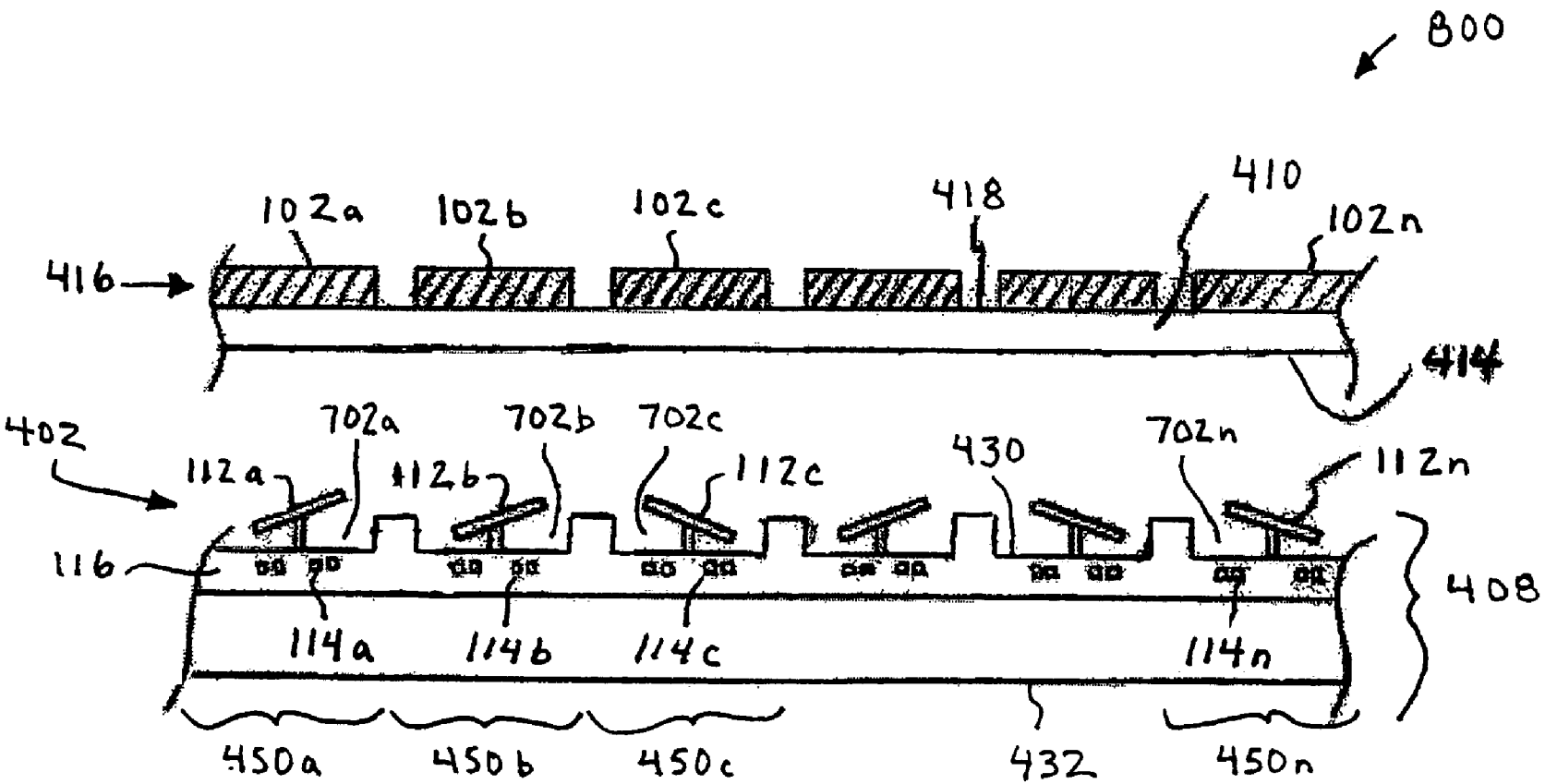

FIG. 8 shows a micro-magnetic switch packaging configuration 800, according to another example embodiment of the present invention. Configuration 800 is similar to configuration 400 shown in FIG. 4, except that plurality of cavities 702*a-n* are formed in first surface 430 of first substrate 408, while plurality of cavities 412*a-n* are not present in second substrate 410. Each of cantilevers 112*a-n* are located in a respective one of cavities 702*a-n*. When first substrate 408 and second substrate 410 are bonded together, plurality of cavities 702*a-n* form a space for each of cantilevers 112*a-n*.

Figure 9:
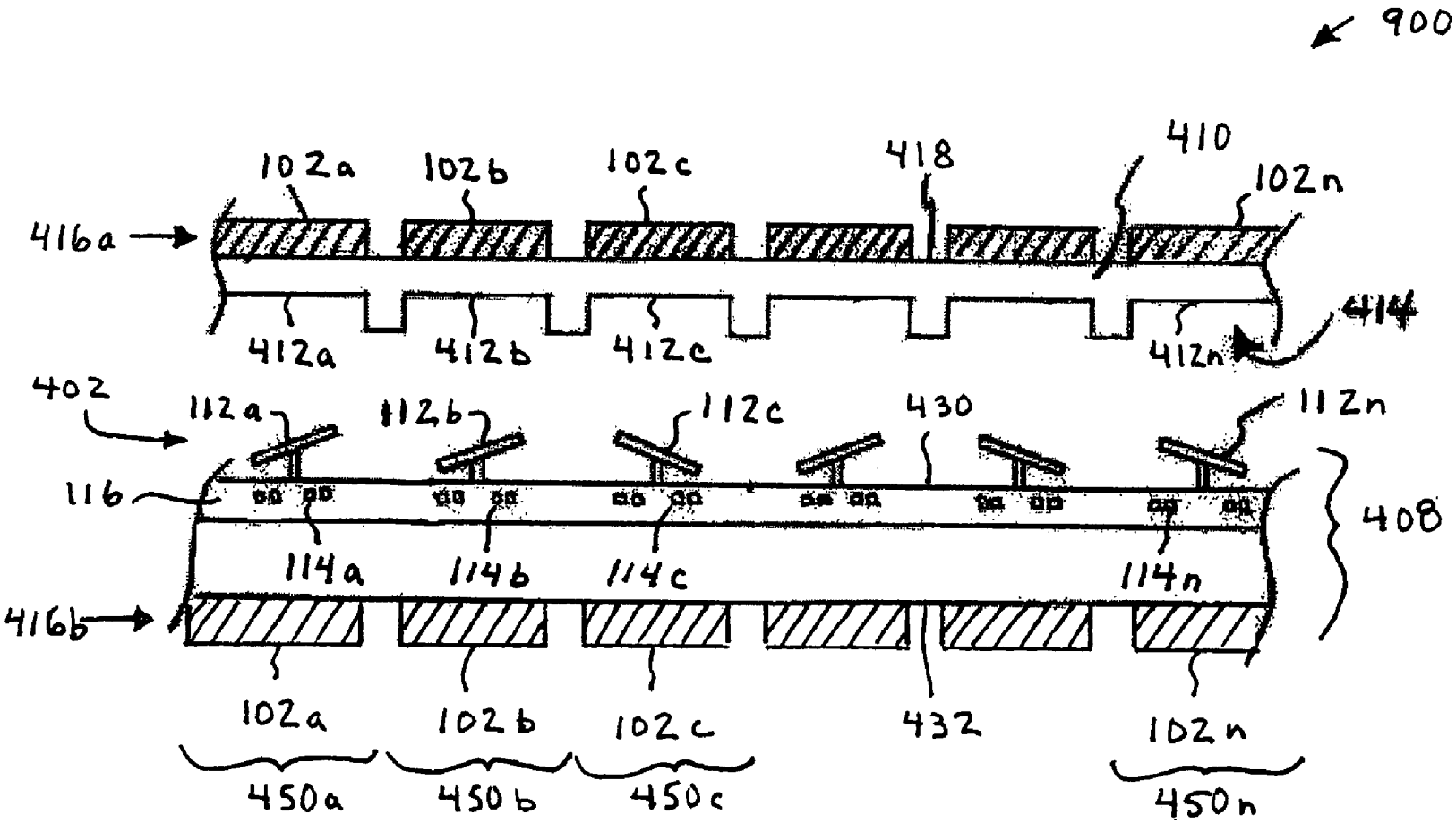

FIG. 9 shows a micro-magnetic switch packaging configuration 900, according to an example embodiment of the present invention. Configuration 900 is similar to configuration 400 shown in FIG. 4, except that a second permanent magnetic layer 416*b* is formed on a second surface 432 of first substrate 408 in addition to a first permanent magnetic layer 416*a* formed on second surface 418 of second substrate 410. In an embodiment, first and second permanent magnetic layers 416*a* and 416*b* are each patterned to include a plurality of permanent magnets 102*a-n*. The combined magnetic fields of permanent magnets 102*a-n* of first and second permanent magnetic layers 416*a* and 416*b* operate to induce a magnetization in the magnetic material of each respective one of cantilevers 112*a-n*. For example, permanent magnet 102*a* of first permanent magnetic layer 416*a* and permanent magnet 102*a* of second permanent magnetic layer 416*b* produce a combined magnetic field that induces the magnetization in the magnetic material of cantilever 112*a*.

Note that in an alternative embodiment, one of first and second permanent magnetic layers 416*a* and 416 is not a permanent magnet layer, but instead is a permalloy layer. Example permalloys for the permalloy layer are described above. The permalloy layer can be patterned so that each package 450 has a respective segment of permalloy to enhance switch performance.

First and/or second substrates 408 and 410 can be formed from any substrate material described elsewhere herein, or otherwise known. For example, first and/or second substrates 408 and 410 can be formed of gallium arsenide, silicon, glass, quartz, ceramics, various organic or magnetic materials, etc. Furthermore, circuitry in addition to switches 402 can be formed on first substrate 408 to be packaged with switches 402, if desired. This additional circuitry can operate with or independently from switches 402.

Figure 10:
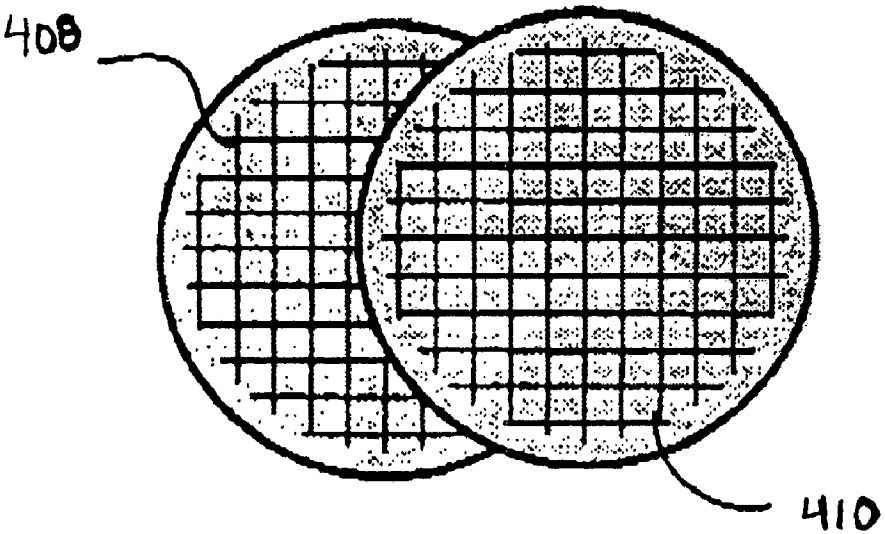
FIG. 10 illustrates example wafer embodiments for the first and second substrates of the present invention.

First and second substrates 408 and 410 can have any size, and can be used to form any number of separate micro-magnetic switch packages. In embodiments, first and second substrates 408 and 410 can be wafer portions, or can be complete wafers, as shown in FIG. 10. Conventional bonding processes, or the like, can be used to attach first substrate 408 and second substrate 410 together. For example, an epoxy, solder, laminate, or other adhesive material can be applied to one or both of first and second substrates 408 and 410. Heat, pressure, or other force, mechanical joint, or process can be applied to bond first substrate 408 and second substrate 410 together. Conventional wafer bonding processes can be used when first and second substrates 408 and 410 are wafers, as shown in FIG. 10. In an embodiment, solder re-flow can be used to bond and self-align first and second substrates 408 and 410.

In an embodiment, a seal ring, such as seal ring 510 shown in FIG. 5C, can be positioned on one or both of first and second substrates 408 and 410 around each switch 402, to improve a seal between first and second substrates 408 and 410 for each switch 402. The seal rings may be patterned on the substrate surface(s) using conventional patterning techniques. Each seal ring can include a thin portion or layer of an adhesive material to improve a resulting seal.

Figure 11:
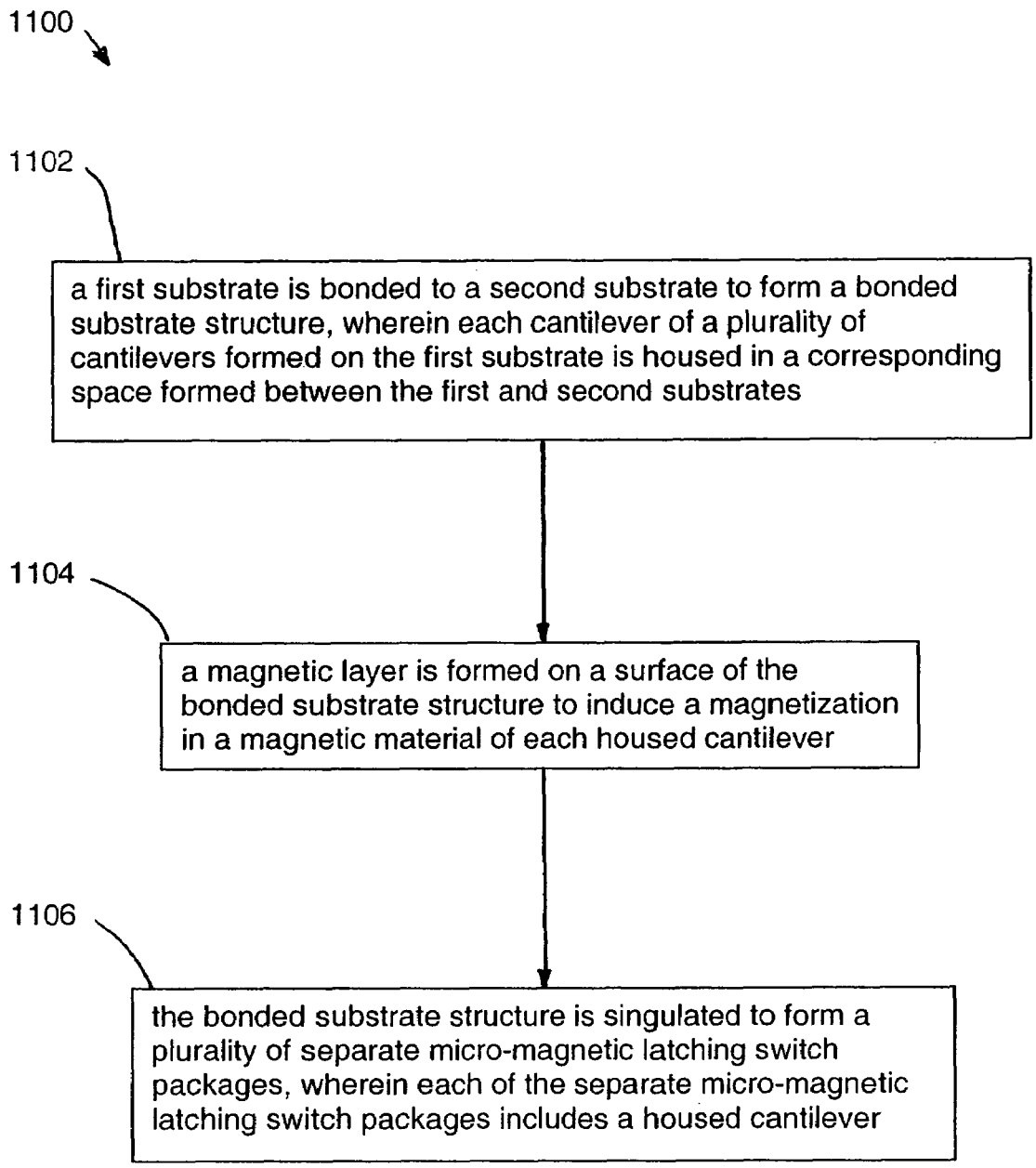
FIG. 11 shows a flowchart providing example steps for packaging micro-magnetic latching switches, according to an embodiment of the present invention.

FIG. 11 shows a flowchart 1100 providing steps for packaging a plurality of micro-magnetic switches, according to an example embodiment of the present invention. The steps of FIG. 11 do not necessarily have to occur in the order shown, as will be apparent to persons skilled in the relevant art(s) based on the teachings herein. Other structural and operational embodiments will be apparent to persons skilled in the relevant art(s) based on the following discussion. These steps are described in detail below.

Flowchart 1100 begins with step 1102. In step 1102, a first substrate is bonded to a second substrate to form a bonded substrate structure, wherein each cantilever of a plurality of cantilevers formed on the first substrate is housed in a corresponding space formed between the first and second substrates. For example, the first substrate is first substrate 408, and the second substrate is second substrate 410, as shown in FIGS. 4 and 6-8. As shown in FIG. 5A, first and second substrates 408 and 410 are bonded together to form bonded substrate structure 500. As shown in FIGS. 4 and 6-8, first substrate 408 has a plurality of cantilevers 112*a-n* formed on first surface 430. As shown in FIG. 5A, when first substrate 408 is bonded to second substrate 410, each of cantilevers 112*a-n* is housed in a respective one of spaces 502*a-n* formed between first and second substrates 408 and 410.

In step 1104, a magnetic layer is formed on a surface of the bonded substrate structure to induce a magnetization in a magnetic material of each housed cantilever. For example, the magnetic layer is permanent magnetic layer 416, as shown in FIGS. 4 and 6-8. Permanent magnetic layer 416 can be formed on either or both of first and second substrates

408 and 410. Permanent magnetic layer 416 is patterned into a plurality of permanent magnets 102*a-n*. Each of permanent magnets 102*a-n* induces a magnetization in a magnetic material of a respective one of cantilevers 112*a-n*. Thus, through actuation of a respective one of coils 114*a-n*, each of cantilevers 112*a-n* is able to move between states, as described above.

In step 1106, the bonded substrate structure is singulated to form a plurality of separate micro-magnetic switch packages, wherein each of the separate micro-magnetic switch packages includes a housed cantilever. For example, as shown in FIG. 5A, bonded substrate structure 500 can be singulated into a plurality of separate micro-magnetic switch packages 450*a-n*. FIG. 5B shows an example separate micro-magnetic switch package 450*a*. Note that any conventional singulation process, including conventional wafer dicing methods, can be employed to singulate bonded substrate structure 500, as will be apparent to persons skilled in the relevant art. Such processes include saw singulation, laser cutting, and other singulation processes.

CONCLUSION

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above. Finally, it should be emphasized that none of the elements or components described above are essential or critical to the practice of the invention, except as specifically noted herein.

What is claimed is:

1. A method for packaging a plurality of micro-magnetic switches, comprising:

(A) providing a first substrate having a plurality of cantilevers spaced apart on a first surface of the first substrate, each cantilever residing in a corresponding cavity in the first surface the first substrate;

(B) bonding a first surface of a second substrate to the first surface of the first substrate, wherein each cantilever is thereby housed in a corresponding space formed between the first and second substrates, the space corresponding to each cantilever formed at least in part by the corresponding cavity in the first surface of the first substrate; and (C) forming a magnetic layer on at least one of the first and second substrates to induce a magnetization in a magnetic material of each housed cantilever.

2. The method of claim 1, further comprising:

(D) singulating the bonded substrate structure to form a plurality of separate micro-magnetic switch packages, each micro-magnetic switch package of the plurality of micro-magnetic switch packages including at least one housed cantilever.

3. The method of claim 1, wherein step (C) comprises patterning the magnetic layer.

4. The method of claim 3, wherein said patterning step comprises screen printing the magnetic layer.

5. The method of claim 3, wherein said patterning step comprises lithographic processing to deposit the magnetic layer.

6. The method of claim 3, wherein said patterning step comprises sputtering the magnetic layer.

7. The method of claim 3, wherein said patterning step comprises electroplating the magnetic layer.

8. The method of claim 3, wherein said patterning step comprises laminating the magnetic layer.

9. The method of claim 8, wherein step (A) comprises:

providing the first substrate having an imbedded plurality of coils in a dielectric material of the first substrate.

10. The method of claim 9, wherein step (A) further comprises:

providing the first substrate having the plurality of cantilevers formed such that each cantilever of the plurality of cantilevers is located adjacent to a corresponding coil of the imbedded plurality of coils.

11. The method of claim 1, wherein the space corresponding to each cantilever is formed by the corresponding first cavity in the first surface of the first substrate and a corresponding second cavity in the first surface of the second substrate, wherein step (B) comprises:

positioning the first and second substrates such that each cantilever is housed in the corresponding first cavity and second cavity.

12. The method of claim 1, wherein step (C) comprises:

forming the magnetic layer on a second surface of the first substrate.

13. The method of claim 1, wherein step (C) comprises:

forming the magnetic layer on a second surface of the second substrate.

14. An apparatus for packaging a plurality of micro-magnetic switches, comprising:

a bonded substrate structure having a first substrate with a plurality of cantilevers formed thereon, a second substrate with a first surface that is bonded to the first substrate, wherein each cantilever of the plurality of cantilevers on the first substrate is housed in a corresponding space formed between said first substrate and said second substrate, wherein a first surface of the first substrate has a plurality of cavities formed therein, wherein the space corresponding to each cantilever is formed at least in part by a corresponding cavity of the plurality of cavities, and a magnetic layer formed on at least one of said first substrate and said second substrate to induce a magnetization in a magnetic material of each housed cantilever;

wherein the bonded substrate structure is singulated to form a plurality of separate micro-magnetic switch packages, each micro-magnetic switch package of the plurality of micro-magnetic switch packages including at least one housed cantilever.

15. The apparatus of claim 14, wherein the magnetic layer is patterned to form a plurality of permanent magnets, each permanent magnet of the plurality of permanent magnets included in a corresponding micro-magnetic switch package of the plurality of micro-magnetic switch packages, wherein each permanent magnet of the plurality of permanent magnets induces the magnetization in the magnetic material of a corresponding housed cantilever.

16. The apparatus of claim 14, wherein a plurality of coils are imbedded in a dielectric material of the first substrate.

17. The apparatus of claim 16, wherein the plurality of cantilevers are formed on a surface of the first substrate such that each cantilever of the plurality of cantilevers is located adjacent to a corresponding coil of the imbedded plurality of coils.

18. The apparatus of claim 16, wherein the first surface of the second substrate has a second plurality of cavities formed therein, wherein the space corresponding to each cantilever is formed by the corresponding cavity of the first plurality of cavities and a corresponding second cavity of the second plurality of cavities.

19. The apparatus of claim 14, wherein the magnetic layer is formed on a second surface of the first substrate.

20. The method of claim 14, wherein the magnetic layer is formed on a second surface of the second substrate.

* * * * *